United States Patent [19]

Lewinton et al.

[11] 4,271,250

[45] Jun. 2, 1981

[54] FIBROUS ELECTROPHOTOGRAPHIC SHEET WITH A CELLULOSE NITRATE COATING

[75] Inventors: Colin H. Lewinton, Montreal, Canada; Joseph Savit, Glencoe, Ill.

[73] Assignee: Domtar Inc., Montreal, Canada

[21] Appl. No.: 96,943

[22] Filed: Nov. 23, 1979

Related U.S. Application Data

[62] Division of Ser. No. 7,493, Jan. 29, 1979, abandoned.

[51] Int. Cl.[3] ..... G03G 5/00; G03G 5/08

[52] U.S. Cl. ..... 430/127; 430/64; 430/87

[58] Field of Search ..... 430/64, 127, 87

[56] References Cited

U.S. PATENT DOCUMENTS 3,839,033 10/1974 Matsuno ..... 430/64

FOREIGN PATENT DOCUMENTS 1062092 2/1964 United Kingdom ..... 430/64

*Primary Examiner*—Edward C. Kimlin
*Assistant Examiner*—J. Goodrow

[57] ABSTRACT

The present invention relates to an electrophotographic sheet material suitable for use as an offset printing master, comprising: a fibrous substrate, a continuous film of cellulose nitrate thereon and a layer of photo conductive material on said film.

1 Claim, No Drawings

FIBROUS ELECTROPHOTOGRAPHIC SHEET WITH A CELLULOSE NITRATE COATING

This is a division of application Ser. No. 007,493, filed Jan. 29, 1979 now abandoned.

FIELD OF THE INVENTION

The present invention relates to electrophotographic sheet material. More particularly, this invention relates to improved electrophotographic sheet material suitable for use as an offset printing master.

BACKGROUND OF THE INVENTION

Electrophotographic sheet material generally comprises a base sheet, for example paper, having thereon a light-sensitive coating, e.g. one containing a photoconductive particulate material in an insulating binder. Typical of such coatings are those containing zinc oxide in a suitable resin binder, such as polyvinylacetate or modified polyvinylacetate. An electrostatic image may be formed on such sheet by exposure to light projected from an original, and a visible image may then be developed and fixed. The sheet with the visible image so formed may then in turn serve as a master plate for offset printing. When used in such capacity, the sheet is treated with an aqueous solution designed to render the non-imaged areas of the sheet hydrophilic (or oleophobic) before running it on the offset press. Conventional sheets tend to be deleteriously affected by such treatment, as could only be expected, notably in that they quickly stretch and crease due to contact with the fountain solution on the press, become weak or delaminate and so on. This limits the number of copies that can be printed with a single conventional master and with a simple conventional master it would be rare to print more than about 1000 copies.

Improvements have been proposed to make such offset printing more durable. Canadian patent 874,905 proposes to apply on a paper base a sizing layer containing a major amount of dialdehyde starch in addition to the usual sizing agents, such as carboxymethyl cellulose, gelatin and the like, and to apply the photosensitive coating on said sizing layers.

Canadian Pat. No. 862,679 proposes an electrophotographic material having an electroconductive back layer, e.g. of a cationic latex and an interlayer made of vinyl polymer and amino resins. These expedients however are either not particularly effective or are very cumbersome and expensive. For example, applying the vinyl polymer and amino resins to paper and curing at a temperature of about 150° C. represents a complex and delicate task. Yet another proposal (Canadian Pat. No. 957,540) is to apply a resin coating, more particularly a cellulose ester coating, to the back of the paper but the results permit only up to 300 copies to be printed.

BRIEF DESCRIPTION OF THE INVENTION

The present invention provides an electrophotographic printing sheet which can be produced in a simple manner and can serve as a master plate for consistently running off impressions on the order of up to five thousand or more using a conventional offset base paper. Accordingly the present invention relates to an electrophotographic sheet material for use as a master in offset printing and comprises a cellulosic base material, a continuous film of cellulose nitrate on said base material, and a photoconductive layer on said film.

DETAILED DESCRIPTION OF THE INVENTION

The cellulosic base material is preferably paper or a like cellulose fibrous sheet material of suitable characteristics. Among the characteristics expected of such paper, an important one is electrical resistivity which is controlled within specified limits. The proper resistivity is generally imparted into the paper in a known manner, in the course of fabrication, e.g. by incorporating additives in the paper body, in the sizing, etc. The paper will generally be sized in a conventional manner and sometimes special ingredients will be incorporated in the sizing to make the paper less absorbent to water or solvents as examplified by the above mentioned incorporation of dialdehyde starch. But unsized papers can also be used, particularly very dense and highly bonded papers. Generally, special grades of paper are used for the making of offset plates, such as Allied Grade X904 or Glatfelter DTMB or LTMP Grades of offset base paper (made respectively by the Allied Paper Company and the Glatfelter Company) or other suitable or similar base materials.

The photoconductive layer, which will form the top coating of the sheet material, is normally a dispersion of photoconductive zinc oxide in a resin system, but other similar materials may be used to form the photoconductive layer. The zinc oxide layer is generally applied as a dispersion of zinc oxide in a resin solution, the solvent being generally an organic non-polar compound, preferably a hydrocarbon such as toluene or the like. The art of forming and applying the photoconductive zinc oxide layer is highly specialized and often relies on an accumulated know-how and skills, however it is not part of the present invention.

The cellulose nitrate film is applied on the fibrous base material to form an intermediate layer between the base and the photoconductive layer. The film is applied in the form of a solution of cellulose nitrate in a suitable solvent, e.g. an alcohol, an ether-alcohol mixture, glycol ether or the like. Various types of cellulose nitrate are available in commerce, differing from one another in viscosity (at given concentration), nitrogen content, etc. Examples are the nitrocellulose products sold by the Hercules Company under the trademarks RS, AS and SS Nitrocellulose. Solutions of a wide range of viscosity and/or solids content may be used. The viscosity will be chosen on the basis of ease of application with given equipment and, using Meyer rods of suitable dimension, we have found the range of viscosities from about 50 to about 1,000 cps to be suitable. The solids content must be such that, upon evaporation of the solvent, a continuous cellulose nitrate film is formed on the base material. We have found the range of between about ½ lb to 6 lbs of cellulose nitrate per ream (3,300 sq ft) of paper to be suitable, depending on the surface, the absorptivity etc. of the paper; for example, in the case of a paper base of high absorptivity a greater amount of cellulose nitrate will have to be used to ensure the formation of a continuous film. The cellulose nitrate coat weight must not be too high, since it may adversely affect curl, electrical properties, stiffness and for flexibility of the base plate; whereas, if it is too low it may not be durable enough.

One of the requirements with regard to an electrophotographic paper base is that its electroconductive properties be such as to permit a sufficiently rapid dissipation of electrostatic charges after exposure to light of the photosensitive layer. Such resistivity should not, in any case, exceed about $10^{13}$ ohms/sq cm., and since the addition of a cellulose nitrate precoat does not substantially modify the resistivity of the base paper over a relative humidity range of about 10 to 80%, it is a material uniquely suited for the purpose herein described.

The resistance of cellulose nitrate to organic aromatic solvents, such as are generally used in zinc oxide-resin dispersion make it further suitable as a barrier layer between the base paper and the photoconductive layer during the zinc oxide coating operation. Additionally, the cellulose nitrate improves the water holdout and dimensional stability of the base sheet which contributes significantly to obtaining improved press run capacity.

Care should be taken not to cause the thus pre-coated base paper to acquire a curl and in certain cases, it may be necessary to employ compatible conventional techniques to avoid curl.

The invention will be further illustrated by means of the following examples:

EXAMPLE 1

Cellulose nitrate, sold under the name RS Nitrocellulose (Hercules Trademark) ¼ sec., was dissolved in glycol ether sold in the trade as CELLOSOLVE (Union Carbide trademark) in the proportion of 14 gm cellulose nitrate and 86 gm CELLOSOLVE (TM). The thus prepared solution was applied by Meyer bar coating methods onto Allied Grade X904, 78 lb. offset base paper. The solvent was allowed to evaporate and the resulting continuous film of cellulose nitrate amounted to about two pounds per ream (3,300 sq ft) of paper. The thus pre-coated paper was then used as a substrate for a conventional zinc oxide coating applied at a weight of about 22 lbs per ream (3,300 sq. ft.). The electrophotographic paper thus produced, when imaged and toner developed, was used as a plate in an offset press. The number of impressions obtained with each plate was always in excess of 5000. When the same paper was used, without pre-coating with cellulose nitrate, as a substrate for a zinc oxide photosensitive coating, the resulting electrophotographic plates run in a similar manner in an offset press, produced only 500–1000 impressions.

EXAMPLE 2

A solution similar to the one in Example 1 was prepared consisting of cellulose nitrate sold under the name SS Nitrocellulose (TM) ½ sec. in ethyl alcohol in the proportion of 10 gm nitrate to 90 gm solvent. The formulation was applied onto a paper in the same manner as the preceding example to form a film of a weight of about 3 lbs. per ream (3,300 sq. ft.). A zinc oxide photoconductive coating of a weight of 20 lbs. per ream (3,300 sq. ft.) was applied onto the thus pre-coated paper. Plates prepared from this electrophotographic paper were used on a conventional offset press and about 5000 impressions were produced with only minimal stretch (about 0.2%) of the offset plate in both the machine and cross-machine directions. A zinc oxide coated identical paper base, but without the intermediate film of cellulose nitrate stretched to about 0.4% in the machine direction and about 2% in the cross machine direction after about 1000 impressions.

EXAMPLE 3

A paper base having a high solvent holdout and sold as E. B. Eddy Silicone Coating base (TM) by the E. B. Eddy Company was coated on both sides with a solution of RS Nitrocellulose (TM) and having ½ second viscosity, was dissolved in CELLOSOLVE (TM) in the proportion 10 g. nitrate to 90 g solvent. This solution, when applied to the paper and dried, provided a pre-coating of 2 lb./ream (3,300 sq. ft.) of substrate. An overcoat of 22 lb./ream (3,300 sq. ft.) of zinc oxide was applied to the precoated substrate. The substrate, so-coated, when imaged, developed, converted and run in an offset press as the offset plate provided about 1,000 impressions per plate. A similar base material with the zinc oxide overcoat, but without the cellulose nitrate coating provided about 50 impressions per plate.

The description and examples provided above are for the purpose of providing a complete disclosure of the invention, and alterations and modifications within the scope of the appended claims, may occur to those skilled in the art.

The embodiments of the invention in which an exclusive property or privilege is claimed are defined as follows:

1. Process for the preparation of electrophotographic sheet material which comprises: coating a fibrous base material with a solution of cellulose nitrate, removing solvent from said solution on said base material so as to form a continuous film consisting of cellulose nitrate, coating a layer of photoconductive material on said film of cellulose nitrate; said film of cellulose nitrate comprising between ½ and 6 lb. per ream (3,300 sq.ft) of said sheet material and said photoconductive material comprises zinc oxide.

* * * * *